US005617807A

United States Patent [19]

Hulse et al.

[11] Patent Number: 5,617,807

[45] Date of Patent: Apr. 8, 1997

[54] CARBON FIBER SPAR AND METHOD OF MAKING

[75] Inventors: David J. Hulse, Mooresville; John G. Heinemann, Charlotte, both of N.C.

[73] Assignee: Isomat, Inc., Charlotte, N.C.

[21] Appl. No.: 489,720

[22] Filed: Jun. 13, 1995

Related U.S. Application Data

[63] Continuation-in-part of Ser. No. 342,142, Nov. 18, 1994, Pat. No. 5,490,472, which is a continuation of Ser. No. 137,286, Oct. 14, 1993, abandoned.

[51] Int. Cl.[6] ..... B63H 15/00

[52] U.S. Cl. ..... 114/90; 114/357; 156/156; 156/169

[58] Field of Search ..... 114/89, 90, 97, 114/357, 112; 441/79, 74; 156/156, 169, 173, 175, 212, 213, 245, 285

[56] References Cited

U.S. PATENT DOCUMENTS

| | | | |
|---|---|---|---|
| 3,270,111 | 8/1966 | Haldemann | 156/156 |
| 4,804,347 | 2/1989 | Ross | 441/79 |
| 5,490,472 | 2/1996 | Hulse et al. | 114/357 |

*Primary Examiner*—Edwin L. Swinehart
*Attorney, Agent, or Firm*—St. Onge Steward Johnston & Reens

[57] ABSTRACT

A carbon fiber spar is provided which comprises a layer of carbon fiber forming a one-piece circumference and having an integral sail-attaching groove formed by a plastic insert bonded together with the layer of carbon fiber during curing so that the fiber layer forms a hollow for receiving the plastic insert in interlocking engagement.

10 Claims, 8 Drawing Sheets

CARBON FIBER SPAR AND METHOD OF MAKING

This is a continuation-in-part application of application Ser. No. 08/342,142 filed Nov. 18, 1994 U.S. Pat. No. 5,490,472, which was a continuation U.S. application Ser. No. 08/137,286 filed on Oct. 14, 1993 and is now abandoned.

FIELD OF THE INVENTION

The invention relates to carbon fiber spars for sailboats and, more particularly, to carbon fiber spars having an integral sail-attaching groove. The invention also relates to methods of making carbon fiber spars.

BACKGROUND OF THE INVENTION

Carbon fiber spars including spinnaker poles and masts are known in the art. Carbon fiber spinnaker poles have been used for a number of years and are generally made in two pieces on tapered male mandrels, or in some instances on male mandrels which are then placed in female molds. The pole pieces are generally formed from resin pre-impregnated sheets which may include either woven carbon fiber or unidirectional carbon fibers on a paper backing. The wider ends are connected together, usually with glue or resin pre-impregnated carbon fiber tape to form a pole tapered toward each end. These spinnaker poles do not include sail attaching grooves but are designed to hold a sail or sail leads outboard of the boat. Fixtures mounted at ends of the pole connect the pole to the sail or sail lead.

Carbon fiber masts are also known. One such design is illustrated in prior art FIGS. 5 and 6. As illustrated in FIG. 5, these masts are made with two longitudinally extending pieces or halves which are glued together, after curing, to form the mast circumference. Each of the pieces is laid up by hand from resin preimpregnated carbon fiber sheets in a female tool. It is necessary to make the prior art mast in two pieces because this permits access to the inside surface of one of the mast pieces for gluing the groove mold and laying-up the sail-attaching groove. The mast piece is cured prior to gluing and lay up.

In other prior art carbon fiber mast designs, the mast is a tapered tube which does not include a sail-attaching groove. Instead, the sail is provided with a sleeve which fits over the tube, or a track is attached to the finished mast for slidingly receiving cars attached along an edge of the sail. These designs are generally overly built and thus disadvantageously excessively heavy. Sleeve type sail attachment prevents the use of rigging to support the mast requiring over building for large masts to be supported. Addition of tracks and cars means excess weight on the mast.

Carbon fiber spars, and especially masts, provide improved performance on sailboats as compared with more typical aluminum masts due to the well known high strength and low weight properties of carbon fiber. Reducing weight in a sailboat mast is important because it reduces the pitching moment by a factor of the square of the distance to the center of mass of the boat. Boats with high pitching moments perform poorly in a seaway. A prior art carbon fiber mast of given size and strength will weigh about one-half as much as an aluminum mast of similar size and strength, providing a sizable reduction in pitching moment and consequent improvement in performance.

Notwithstanding these advantages, most sailboat design classes, measurement rules, and performance or other handicapping systems have banned prior art carbon fiber masts as too expensive due to the time and labor required to lay up the mast by hand, to lay up the mast in pieces, to pre-core a piece of the mast, to glue in a groove mold, to lay up the groove mold or spacer by hand, and/or to glue the pieces together.

Another disadvantage of prior art carbon fiber masts is that the inside surface of the mast may be rough and irregular due to the hand lay-up process. This rough surface may snag or abrade the halyards and other sail control lines which pass within the mast, accelerating wear, and necessitating more frequent replacement.

The manual construction of prior art masts may provide a varying thickness around the circumference and along the length of the mast which may cause irregular flex characteristics. Similarly, manual construction may lead to nonreproduceable flex characteristics among a series of masts intended to be identical. Manual manufacturing may also introduce defects into the mast such as air pockets which may lead to premature breakage. The glue used to combine mast pieces or components may fail in the harsh sailing environment of temperature extremes and salt water, causing spar failure and possibly injuring sailors. Further, manual manufacture may increase material costs in requiring glue, excess carbon fiber, excess resin, and may also increase material costs due to wastage and spoilage of resin preimpregnated carbon fiber sheets which may have a limited shelf life.

What is desired, therefore, is a carbon fiber spar having an integral sail-attaching groove which may be economically formed in order to attain the performance advantages of carbon fiber at little or no additional cost as compared with aluminum. Such a spar would likely be approved for use in virtually all design classes, measurement rules and handicapping systems. Providing the spar with a smooth inner surface and forming the spar without a gluing step, multiple curing steps, and manual carbon fiber lay up are also desirable.

SUMMARY OF THE INVENTION

Accordingly, it is an object of the invention to provide a carbon fiber spar to attain the performance advantages of carbon fiber at little or no additional cost as compared with aluminum spars.

Another object of the invention is to provide a high modulus fiber spar having an integral sail-attaching groove.

A further object of the invention is to provide a carbon fiber spar of the above character including a smooth inner surface.

Yet another object of the invention is to provide a carbon fiber spar of the above character without gluing mast pieces together.

Still another object of the invention is to provide a carbon fiber spar of the above character without routering out the sail-attaching groove.

Yet still another object of the invention is to provide a carbon fiber spar of the above character which has a relatively uniform thickness or desired nonuniform thickness around its cross section.

A yet still further object of the invention is to provide a method of making a spar of the above character by weaving a layer of carbon fiber from individual strands.

These and other objects are achieved by provision of a carbon fiber spar comprising a layer of carbon fiber having an integral sail-attaching groove formed by a plastic insert bonded together with the layer of carbon fiber during curing. The fiber layer forms a hollow for receiving the plastic insert in interlocking engagement.

The layer of fiber is preferably a seamless sleeve or tube which is most preferably woven on the mandrel from spools of individual fiber. The insert includes a plurality of ridges on its outer surface for increasing the bonding surface area on the insert. For interlocking with the fiber layer, the insert also includes two wide outer diameter portions and an intermediate narrow outer diameter portion for receiving excess circumferential portion of the fiber layer to form a hollow. The insert includes a neck portion for retaining a sail edge rope.

In another aspect the invention provides a method of making the spar of the invention which comprises the steps of forming a fiber layer on a mandrel, urging the layer outwardly into a female mold, urging the layer around an insert removably mounted within the mold and curing the fiber layer.

The first urging step preferably comprises lowering a pressure between the mold and the fiber layer. The second urging step preferably comprises increasing a pressure within the fiber layer. The method preferably also includes, between forming and urging, the step of reducing a circumference of the mandrel.

The invention and its particular features and advantages will become more apparent from the following detailed description considered with reference to the accompanying drawings.

DETAILED DESCRIPTION OF THE INVENTION

Figure 1:
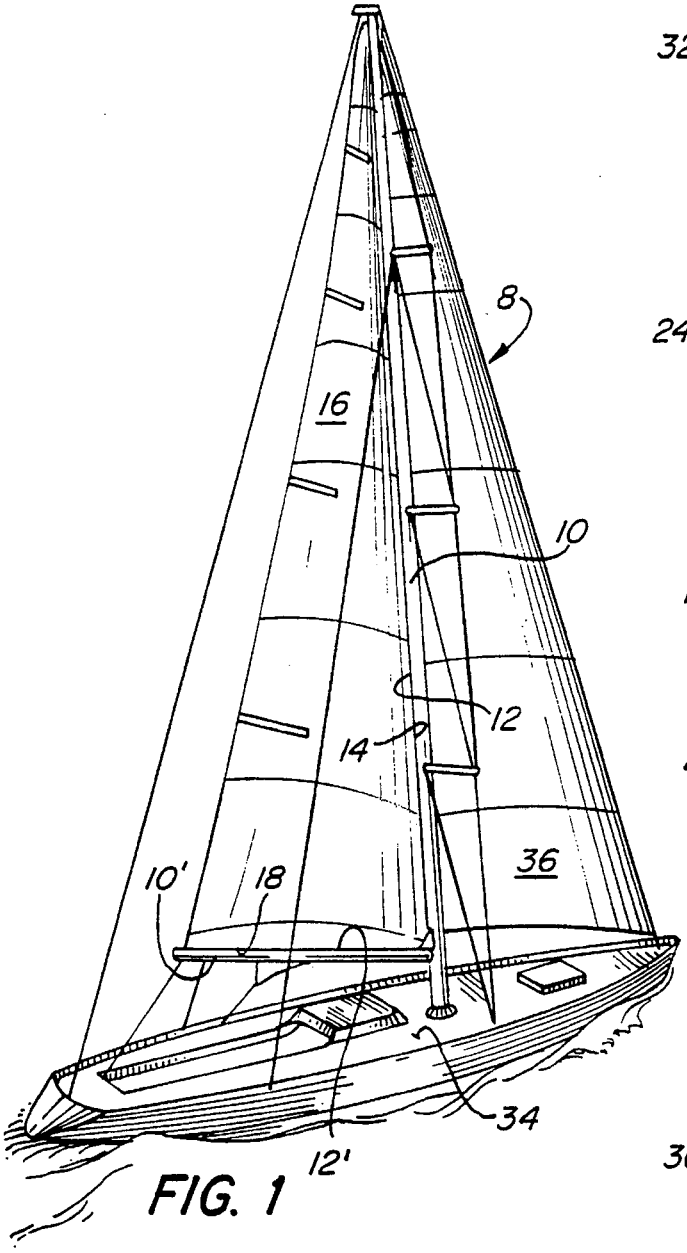
FIG. 1 is a front isometric view of a carbon fiber spar in accordance with the invention in use on a sailboat.

Carbon or other high modulus fiber spars 10, 210, 10', 210' in accordance with the invention are mounted and in use on a sailboat 8 illustrated in FIG. 1. Spar 10 is a mast and includes a groove 12 for attaching a luff edge 14 of mainsail 16 thereto. Spar 10', 210' is a boom and includes a groove 12' for attaching a foot edge 18 of sail 16 thereto. It is understood that other spars including an integral sail-attaching groove, such as jib booms, gaffs, yards and the like are also possible and within the scope of the invention. Although, for simplicity, only masts 10, 210 are described in detail, it is also understood that other spars would operate and be manufactured in the same or a similar manner. Similarly, although the mast is preferably a resin matrix reinforced with carbon fiber, it is understood that KEVLAR®, SPECTRA®, Fiberglass, and other fibers, particularly high modulus fibers may also be used.

Figure 2:
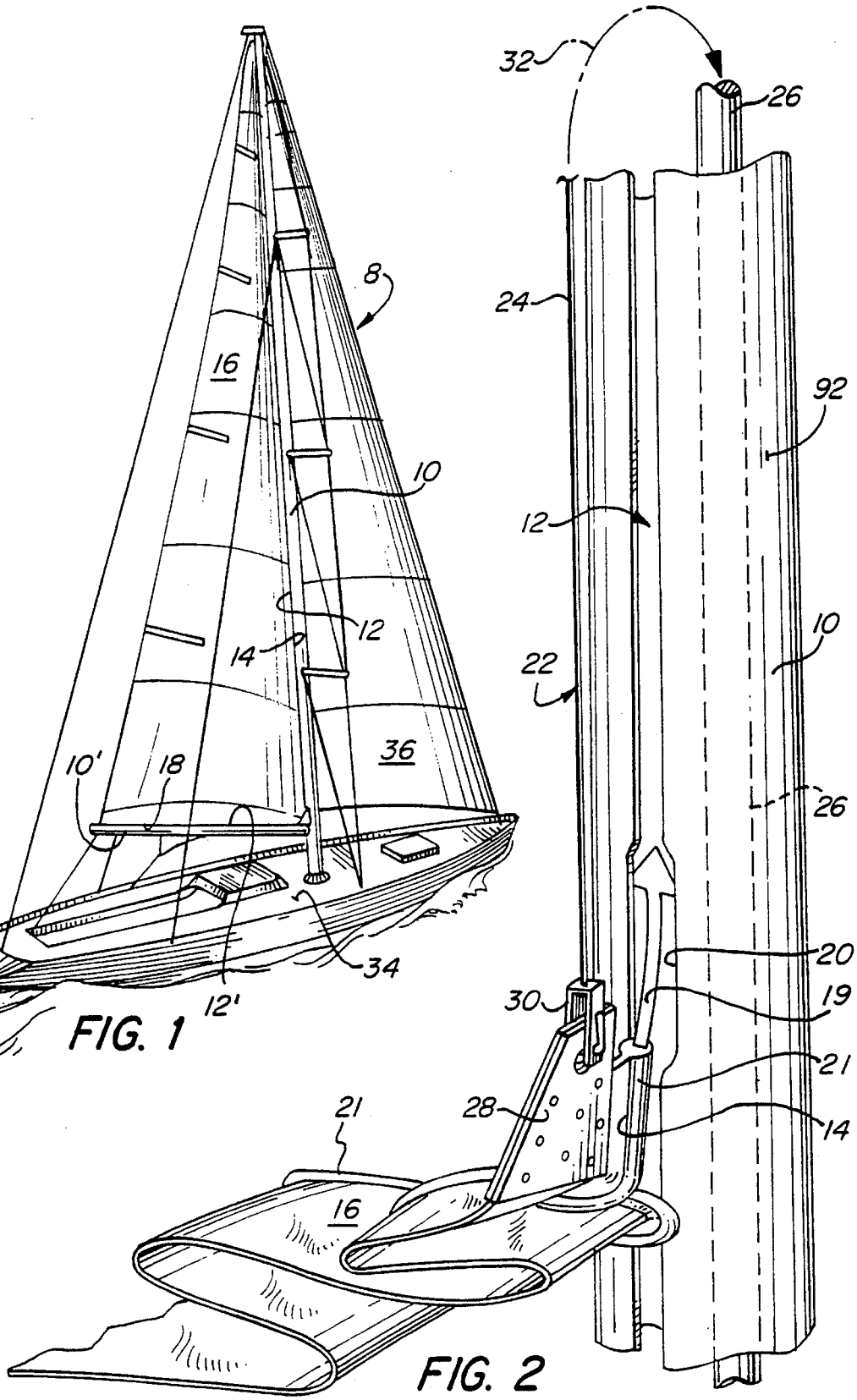
FIG. 2 is an enlarged partial view of the carbon fiber spar of FIG. 1 illustrating operation and use of the integral sail attaching groove.

Referring now also to the enlarged partial view of masts 10, 210 in FIG. 2, additional details of the mast are illustrated. Mast 10 includes a feed slot 20 for feeding luff edge 14 of sail 16 into luff groove 12 as indicated by arrow 19. Edge 14 is retained within sail attaching groove 12 by a luff rope 21 or the like sewn into edge 14.

Edge 14 is fed into slot 20 as sail is pulled up by a halyard 22 or other sail control line (e.g. an outhaul in the case of boom 10') which may comprise a cable 24 or a rope 26 or both. Halyard 22 is connected to a head 28 of sail 16 by a shackle 30 joined to cable 24. Halyard 22 extends to the top of masts 10, 210 turns around a sheave (not shown but indicated by dashed line 32) mounted therein and extends back down toward deck 34 of sailboat 8 within masts 10, 210. Halyards for the spinnaker sail (not shown) and jib sail 36, as well as other sail control lines, also pass within masts 10, 210 in order to reduce windage and tangling.

Figure 5:
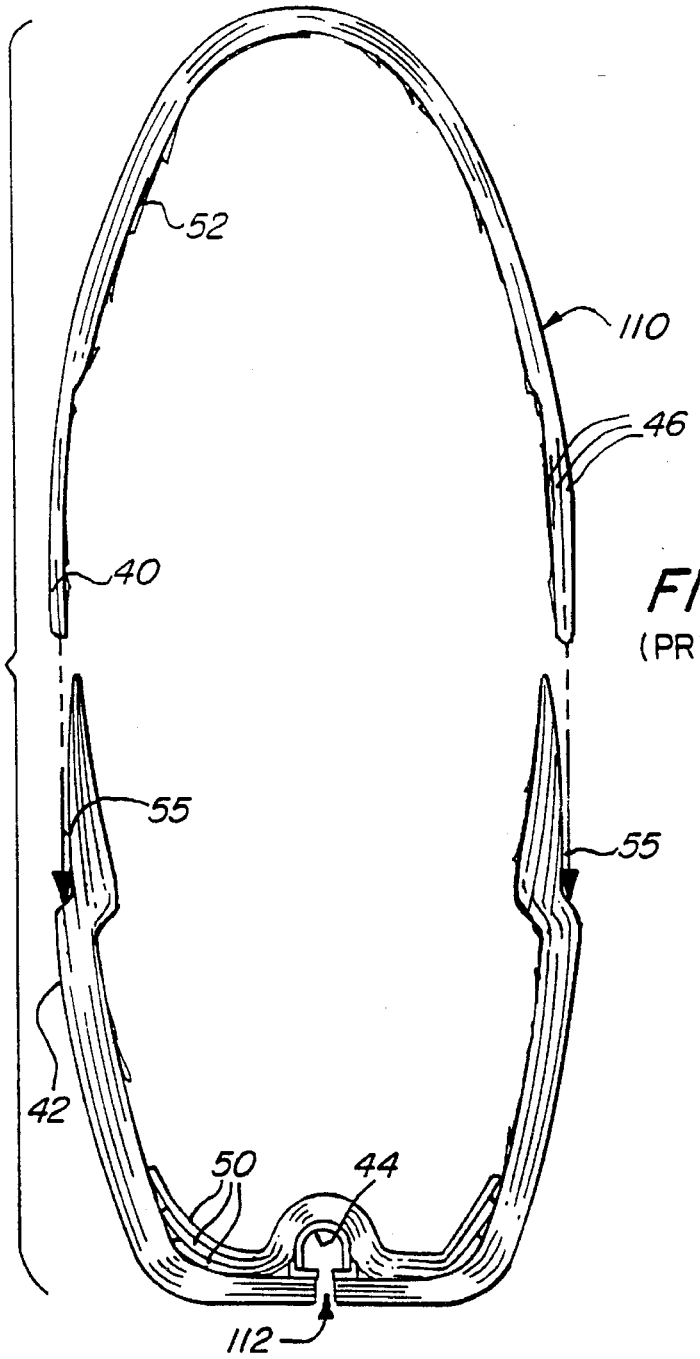
FIG. 5 (PRIOR ART)
FIG. 5 is an exploded end cross-sectional view of a prior art carbon fiber mast.
Figure 6:
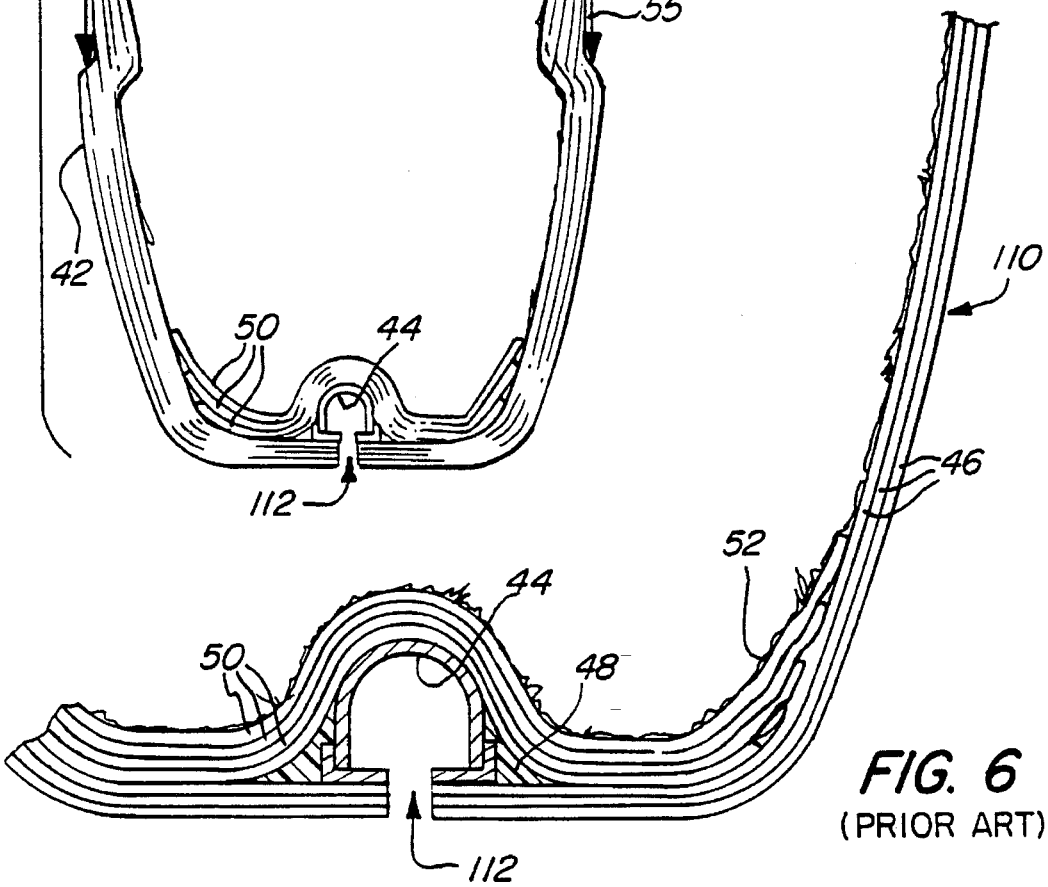
FIG. 6 (PRIOR ART)
FIG. 6 is an enlarged, partial end cross-sectional view of the prior art carbon fiber mast of FIG. 4 depicting construction of the luff groove in additional detail.

The benefits of carbon and other high modulus fiber reinforcements, i.e., low weight and high strength, are well known. Also generally known is that reducing the weight of masts would provide improvements in sailboat performance. What is not known, however, is a carbon or other high modulus fiber mast which can be made at a reasonable price, how to manufacture large quantities of fiber reinforced masts, and how to reproduceably manufacture fiber reinforced masts such that each mast is substantially identical to all prior masts. Reproduceability and low cost are not reliably achieved by the prior art mast 110 illustrated in FIGS. 5 and 6 due to its two piece design, and manual lay-up construction.

Mast 110 is generally a one-of-a-kind spar used in America's Cup racing where the racing rules do not limit the amount of money which may be spent by a competitor. These masts were very expensive, but the America's Cup design rules encourage innovation regardless of cost.

Mast 110 is made from front and back halves 40, 42 to provide access for attaching groove mold 44 to outer carbon fiber layers 46 with glue 48. Layers 46 are laid-up by hand and precured prior to attachment of groove mold 44. Next, additional carbon fiber layers 50 are hand laid over mold 44 and cured layers 46. Inner surface 52 of layers 46 and 50 may be rough and irregular due to the hand lay-up process. A rough inner mast surface mast is disadvantageous because it may snag or abrade sail control lines passing therethrough.

After layers 50 have been cured, mast halves 40, 42 are then glued together, as indicated by arrows 55 in FIG. 4, to form a mast having a two piece circumference. Mast 110 has a wall thickness which may vary along its length in addition to varying around its circumference. The varying thickness of prior art mast 110 may disadvantageously effect predictability of flex characteristics and reduce mast reproduceability. Identicalness of successive masts is necessary if fiber reinforced masts are to be adopted by sailboat design classes and approved for use in sailboat races.

Figure 3:
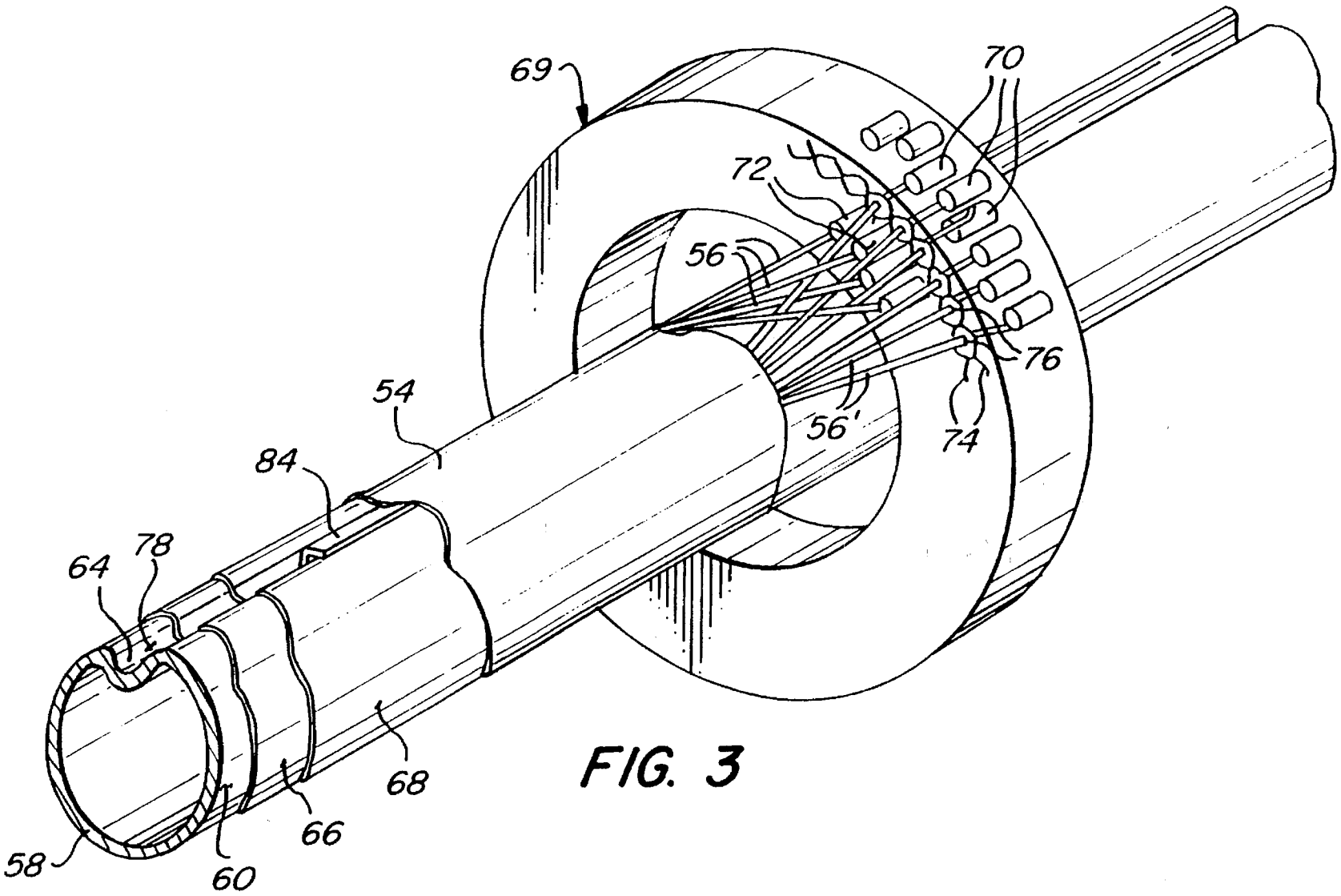
FIG. 3 is a front isometric view of a braiding machine illustrating manufacture of the carbon fiber spar of FIG. 1 and depicting the various layers of material applied to the mandrel to make the spar.

Referring now to FIGS. 3 and 4A–4E, the details of construction and a method of making mast 10 in accordance with another object of this invention are shown. FIGS. 4A–4E illustrate stages or steps in the manufacturing process and FIG. 3 illustrates application of outer sleeve, seamless layer or ply, or tube 54 of high modulus fiber 56. It is understood that inner sleeve 68 of fiber is applied in the same manner by the same device.

Figure 4A:
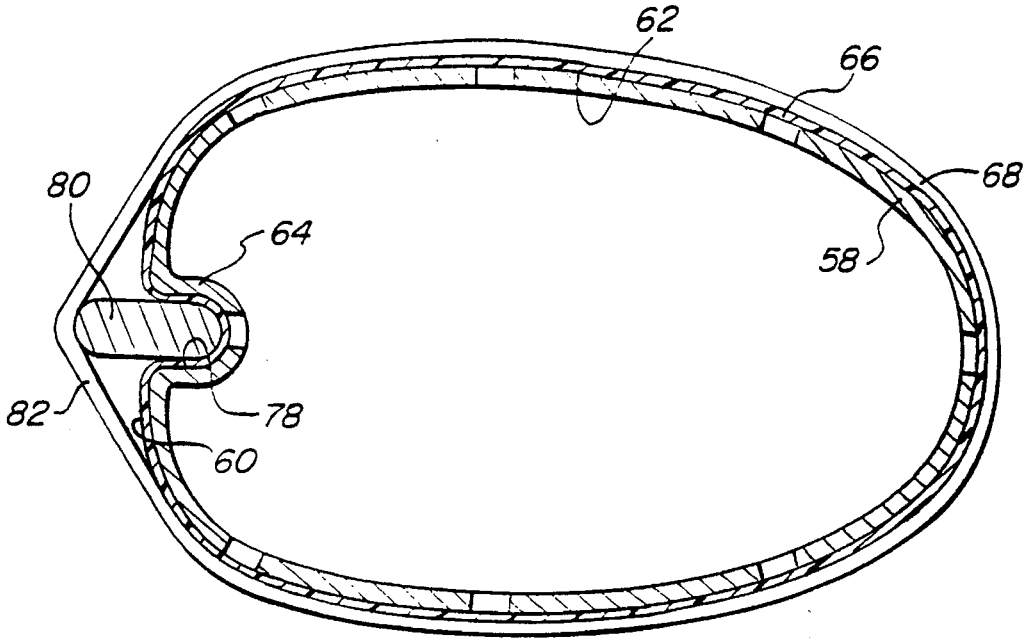
FIGS. 4A–4E are end cross-sectional views of the carbon fiber spar of FIG. 1 illustrating various stages in a method of making a carbon fiber spar in accordance with another aspect of the invention.

Beginning with FIG. 4A, mast 10 is built upon a male mandrel 58 the outer surface 60 of which (see FIG. 3) molds, forms or tools inner surface 62 of the mast smooth to reduce the possibility of snagging or abrading sail control lines passing therethrough. Mandrel 58 is conveniently formed from extruded aluminum, and includes a longitudinal slot 64. An inner plastic layer or sleeve 66 is placed over mandrel 58 for later use to vacuum bag mast 10, as described below with reference to FIGS. 4D and 4E.

Next, an inner layer 68 of high modulus or carbon fiber 56, 56' is braided or woven onto mandrel 58. Layer 68 is preferably a seamless tube or sleeve, but may also comprise a seamed sleeve or the inner ply of a wrapped sheet. It is also understood that instead of applying individual fibers, layer 68 may be composed of individually applied fiber bundles, or of fiber sheets or fabric wrapped around the mandrel.

As illustrated in FIG. 3, sleeve 68 is woven on mandrel 58 by braiding head 69 from substantially longitudinal or warp fibers 56' dispensed from a plurality of fixed bobbins 70 and substantially helical or spiralling fill fibers 56 dispensed from a plurality of orbiting bobbins 72. Warp fibers 56' may also be introduced from spools and guides which allow application directly to mandrel 58 without being interwoven with fill fibers 56. In this regard the properties of a high modulus fiber such as carbon can be fully realized since the warp fibers are in line with compression loads on the mast without being bent around fill fibers. Further, by introducing fill fibers at only selected locations along mast 10, the thickness and flex characteristics of the mast can be tailored and controlled.

Successive bobbins 72 follow alternating ones of serpentine paths 74 which repeatedly pass under and over warp fibers 56'. Warp fibers 56' pass through thread guides 76 located between paths 74. Resin is individually applied to fibers 56, 56' by a plurality of associated rings or funnels (not shown) as the fibers are drawn from bobbins 70, 72. Bobbins 72 orbit mandrel 58 as either the mandrel or braiding head 69 is moved longitudinally such that fibers 56 are dispersed along spiralling paths. Braiding head 69 is only shown schematically and it is understood that it is either mounted on the floor or with an overhead gantry system. Braiding head 69 may be provided as a Wardwell Braiding Machine from the Wardwell Braiding Machine Company, 1211 High Street, Central Falls, R.I. 02863.

Inner layer 68 is applied with a circumference sufficient to cover the entire outer surface 60 of mandrel 58 including inverted surface 78 of slot 64. By "inverted" is meant that surface 78 is concave out. Since braiding head 69 is only capable of applying fiber directly to surfaces which are convex about the radial axis x, a removable mandrel extender rod 80 is placed within slot 64 prior to sleeve 68 application. Mandrel extender rod 80 extends the effective concave in circumference of mandrel 58 to provide sleeve 68 with an excess circumferential portion 82 sufficient to cover surface 78 of groove 64. By "excess" is meant that part of the circumference which is greater than a circumference of mast or spar 10.

Figure 4B:
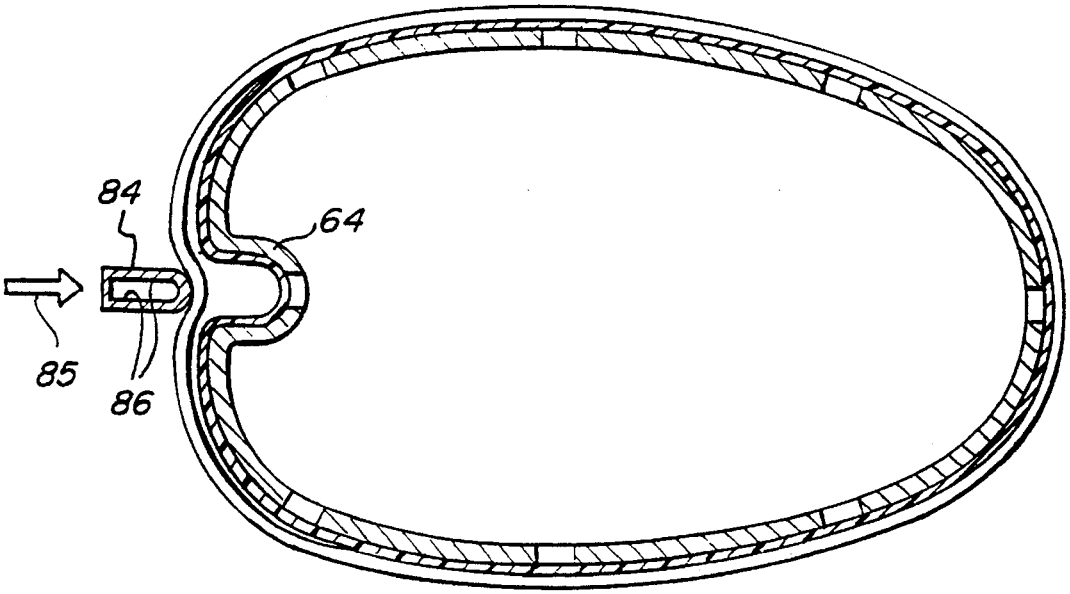

After application of layer 68, mandrel extender rod 80 is removed and excess circumferential portion 82 is pressed into slot 64, as illustrated in FIG. 4B, to cover surface 78. It is understood that instead of removable extender 80, the effective circumference of mandrel 58 may be reduced a number of other ways such as by creating slot 64 in the mandrel, by deflating an inflatable mandrel, or by mechanically reducing the size of the mandrel. A spacer 84 made of a heat resistant plastic such as PVC or the like is used to press excess 82 into slot 64 as indicated by arrow 85. Spacer 84 substantially completely fills slot 64, reducing the circumference of mandrel 58 without reducing the effective circumference for application of high modulus sleeves. In this regard, spacer 84 fills slot 64 such that the combination of mandrel 58 and spacer 84 is entirely concave in. Spacer 84 is hollow and forms the inner walls 86 of sail attaching groove 12.

Figure 4C:
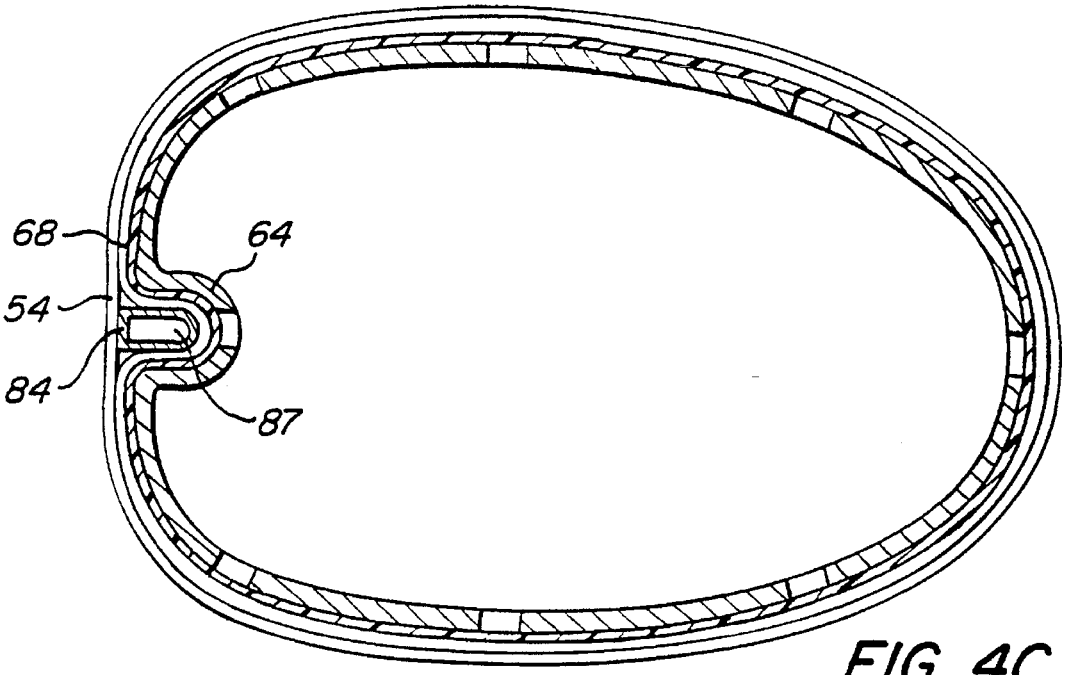

Referring to FIGS. 3 and 4C, mandrel 58 including plastic layer 66, high modulus layer 68, and spacer 84 is returned to braiding machine 69 for application of outer layer 54 of high modulus fibers 56, 56'. Like layer 68, layer 54 is preferably a seamless tube or sleeve, but may also comprise a seamed sleeve or the outer ply of a wrapped sheet. Outer layer 54 has a smaller circumference than inner layer 68 of fiber since inner sleeve 68 forms not only the circumference of mast 10 but also the inwardly extending sail attaching groove 12. Layers 54 and 68 contact each other completely around mandrel 58 except for a hollow 87 along slot 64 where inner layer 68 follows groove surface 78 while outer layer 54 follows the effective or non-inverted circumference of mandrel 58.

Figure 4D:
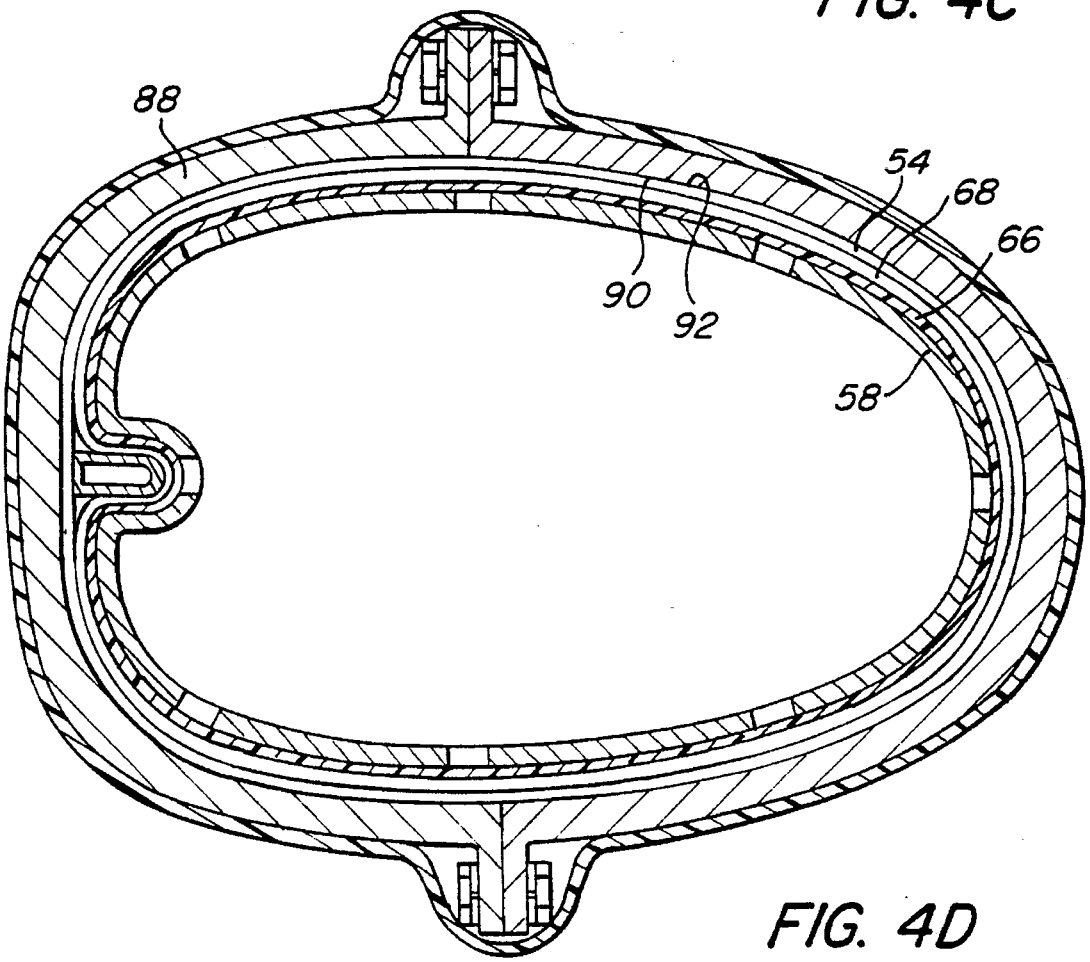

Referring now to FIG. 4D, mandrel 58, including plastic layer 66, inner and outer high modulus fiber layers 54, 68, and spacer 84, is placed in a two part female mold 88. Mold 88 includes an inner surface 90 which forms, molds or tools an outer surface 92 (also see FIG. 2) of mast 10. Next, a plastic layer, bag or sleeve 94 is placed over mold 88 to encase high modulus fiber layers 54 and 68 between plastic layers. A vent line (not shown in any Figure) is sealed between plastic layers 66 and 94, and is connected to a vacuum pump creating a vacuum bag for effectively pressing layers 54 and 68 together with an equivalent pressure of about 14 psi.

Figure 4E:
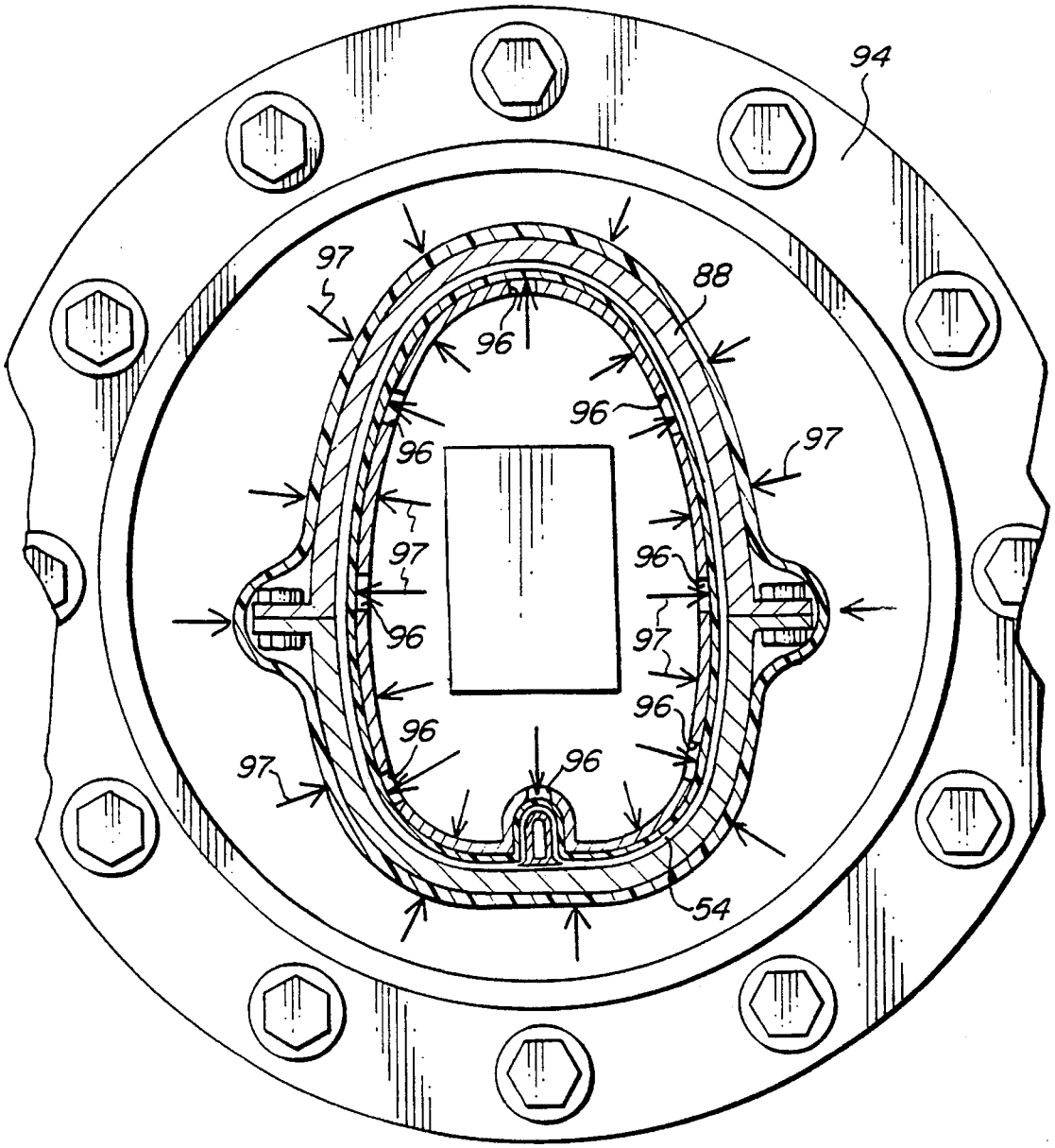

Referring to FIG. 4E, the entire assembly of FIG. 4D is placed within a pressure chamber 94. Mandrel 58 is hollow and includes a plurality of holes 96 permitting equalization of pressure on both sides of mold 88 as indicated by arrows 97. By pressurizing both sides of the vacuum bag up to about 150 psi, chamber 94 exerts an effective pressure of up to about 164 psi, and preferably between about 42 and 112 psi, to fiber layers 54, 68. Layers 54 and 68 are combined, cured or bonded into an integral one piece mast, by the resin applied to the individual fibers, with a combination of pressure and heat provided by a heating element 98 located within mandrel 58. Heating element 98 is adjustable to vary the ramp up, dwell and cool down times and temperatures.

Mast 10 is completed by removing mold 88 and mandrel 58, and cutting through outer layer 54 into the hollow center of spacer 84 to complete luff groove 12. A feed slot 20 (see FIG. 2) may also need to be cut in outer layer 54.

Figure 7A:
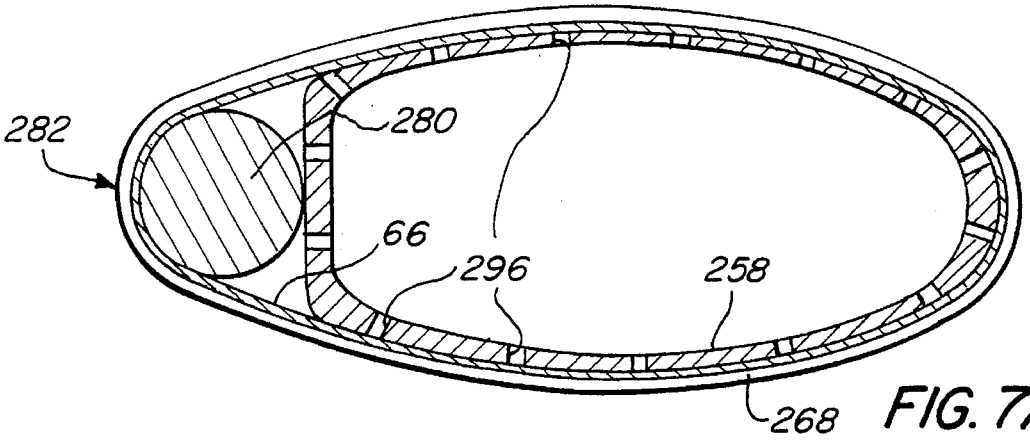
FIGS. 7A–7C are end cross-sectional views of the carbon fiber spar of FIG. 9 illustrating various stages in another method of making a carbon fiber spar in accordance with another aspect of the invention.
Figure 7B:
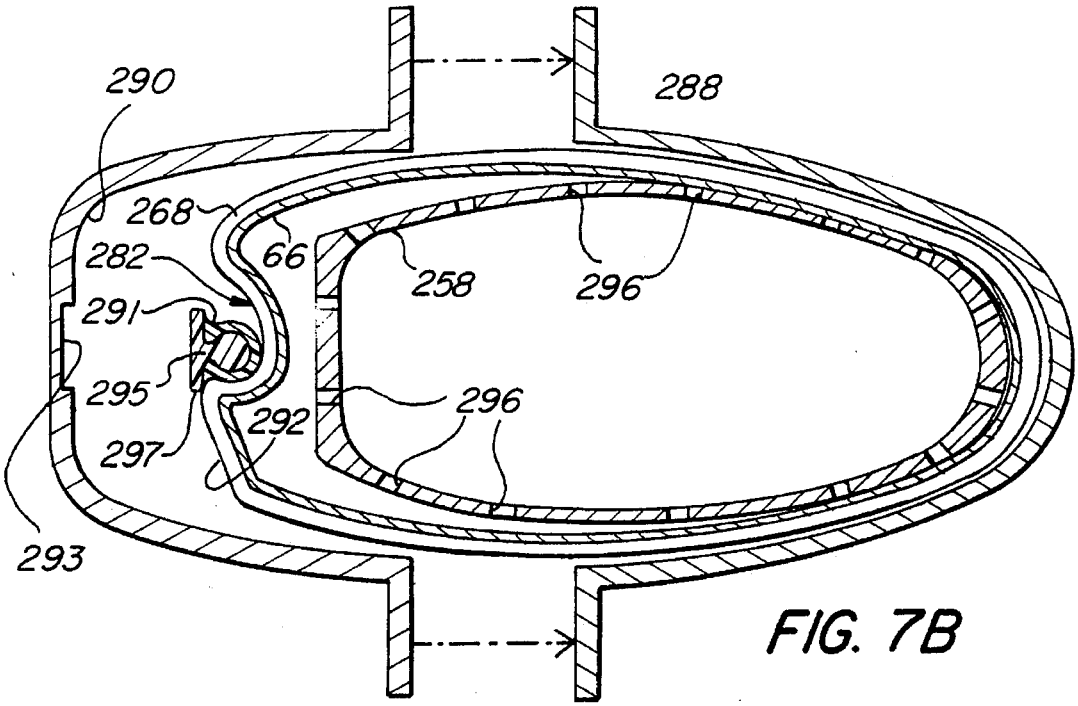
Figure 7C:
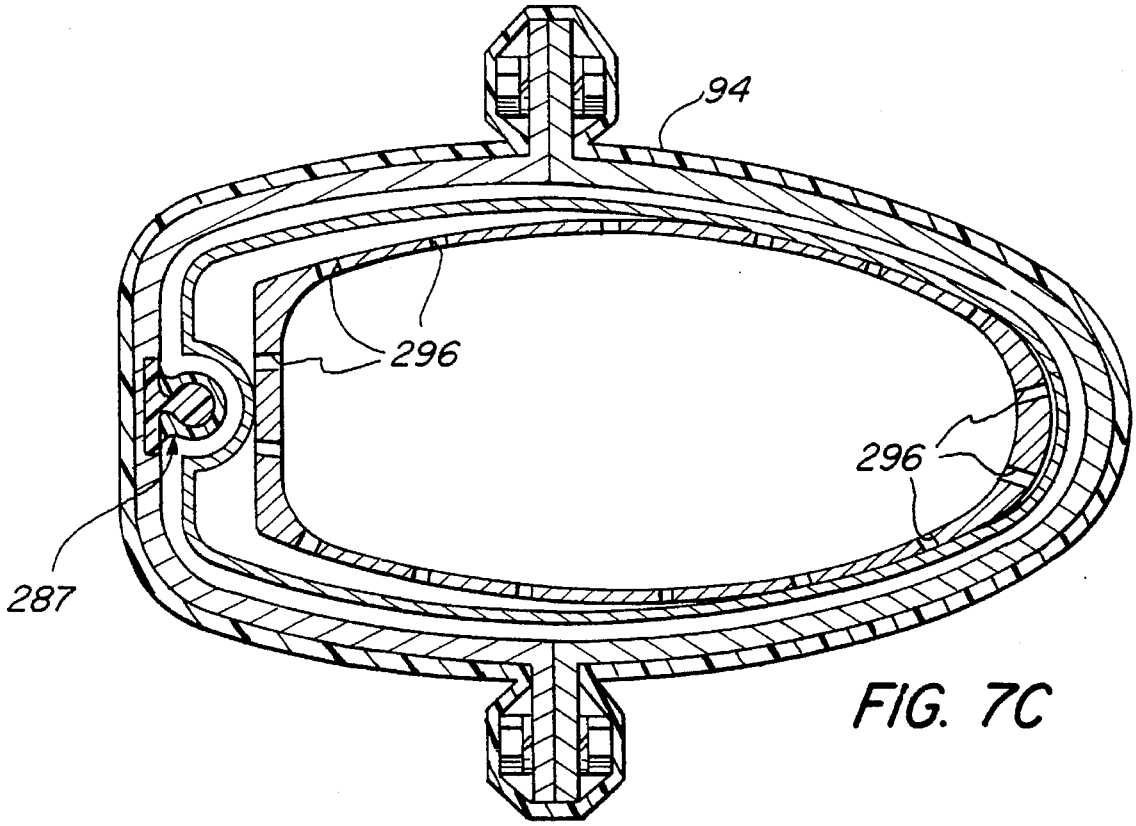
Figure 9:
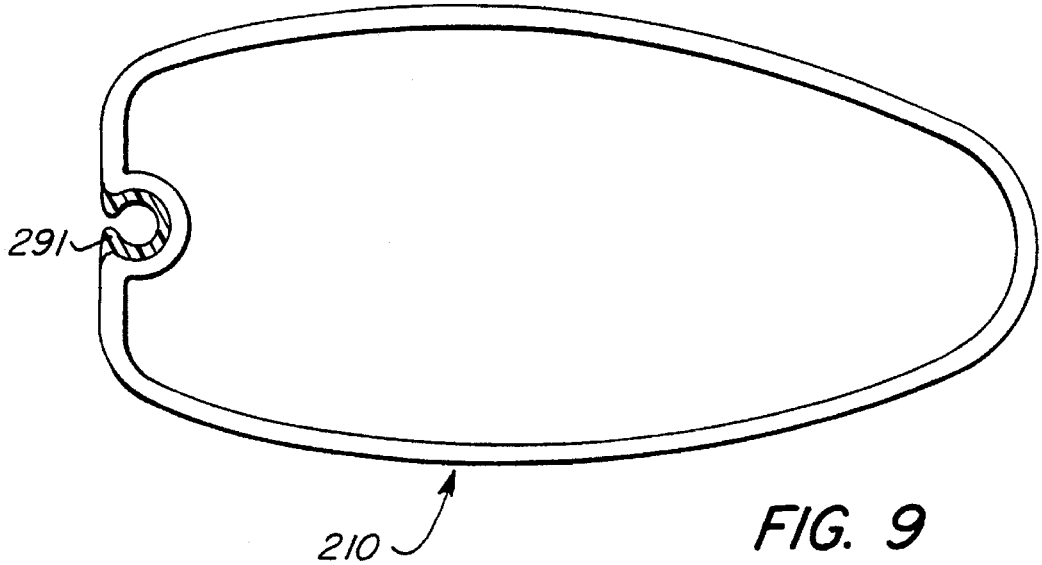
FIG. 9 is an end cross-sectional view of another embodiment of the carbon spar of FIG. 1.

Referring now to FIGS. 7A–7C, the details of construction and a method of making mast 210 in accordance with an another aspect of the invention are shown. FIGS. 7A–7C are intended to depict differences between the process of making mast 210 and the above described method of making mast 10. In this regard, brief reference may be made to FIGS. 3 and 4A–4E for details of the construction and method of making mast 210 which are substantially the same as for mast 10.

Beginning with FIG. 7A, mast 210 is built upon a male mandrel 258 over a plastic layer or sleeve 66 is placed over mandrel 58 for later use to vacuum bag mast 210.

A layer 268 of high modulus or carbon fiber 56, 56' is braided or woven onto mandrel 258. Layer 268 is preferably a seamless tube or sleeve, but may also comprise a seamed sleeve or the inner ply of a wrapped sheet. It is also understood that instead of applying individual fibers, layer 268 may be composed of individually applied fiber bundles, or of fiber sheets or fabric wrapped around the mandrel. The weaving of layer 268 is substantially the same as the weaving of inner layer 68 which is described above with reference to FIG. 3 for mast 10.

Layer 268 is applied with a circumference greater than that of mandrel 258 by means of a removable mandrel 280 positioned adjacent mandrel 258 prior to sleeve 268 application. Mandrel extender rod 280 extends the effective circumference of mandrel 258 to provide sleeve 268 with an excess circumferential portion 282 sufficient to surround longitudinal insert 291. By "excess" is meant that part of the circumference which is greater than a circumference of mast or spar 210.

After application of layer 268, mandrel extender rod 280 is removed. It is understood that instead of a removable extender 280, the effective circumference of mandrel 258 may be reduced a number of other ways such as by deflating an inflatable mandrel, or by mechanically reducing the size of the mandrel. Next, as illustrated in FIG. 7B, mandrel 258 and woven fiber layer 268 are placed within a two-part female mold 288.

Mold 288 includes an inner surface 290 which forms, molds or tools an outer surface 292 of mast 210. A plastic layer, bag or sleeve 94 is placed over mold 288 to encase high modulus fiber layer 268 between plastic layers (see FIG. 7C). A vent line (not shown in any Figure) is sealed between plastic layers 66 and 94, and is connected to a vacuum pump creating a vacuum bag for effectively pressing layer 268 and inner mold surface 290 together with an equivalent pressure of about 14 psi.

Figure 8:
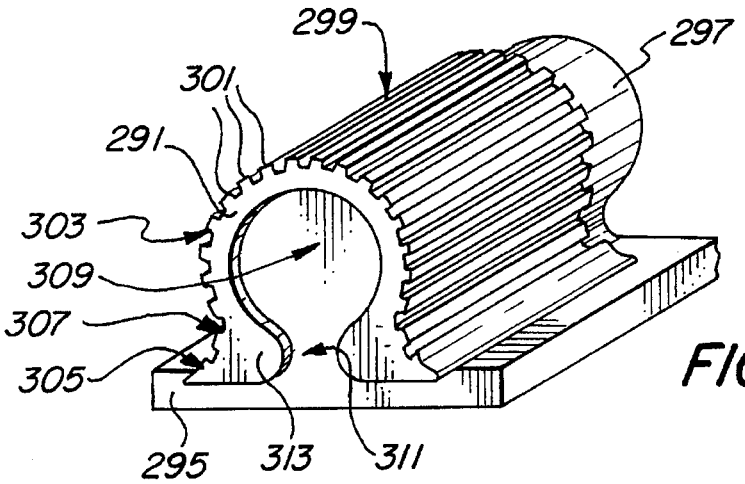
FIG. 8 is an enlarged isometric view of a luff groove insert and mandrel tool insert used in the method of FIGS. 7A–7C to make the carbon fiber spar of FIG. 9.

Inner surface 290 of mold 288 includes a recess 293 (see FIG. 7B) sized to receive a base 295 of removable insert mandrel 297. Insert mandrel 297 receives longitudinal insert 291 thereon and holds it in place while fiber layer 268 is applied thereover prior to curing. Referring also to FIG. 8, an outer surface 299 of insert 291 includes a plurality of ridges 301 which provide additional surface area for bonding to layer 268.

Insert 291 includes first and second wide outer dimension portions 303, 305 and a narrow outer dimension portion 307 located between the wide portions. Wide portion 303 surrounds a wide, inner dimension portion 309 which—in use—receives rope or other fittings 21 therein (see FIG. 2) to attach a sail. Narrow portion 307 is aligned with a narrow inner dimension portion 311 which forms a neck 313 to retain sail 16 within groove 12. Narrow outer dimension 307 forms a pinched-in area between adjacent wide outer dimensions 303, 305 for receiving portions of fiber layer 268 which, upon curing, mechanically lock insert 291 within hollow 287 (see FIG. 7C).

Referring briefly to FIG. 4E, the entire assembly of FIG. 7C is then placed within a pressure chamber 94. Mandrel 258 is hollow and includes a plurality of holes 296 permitting equalization of pressure on both sides of mold 288. By pressurizing both sides of the vacuum bag up to about 150 psi, chamber 94 exerts an effective pressure of up to about 164 psi, and preferably between about 42 and 112 psi, to fiber layer 268. Layer 268 is combined, cured or bonded into an integral one piece mast, by the resin applied to the individual fibers, with a combination of pressure and heat provided by a heating element 98 located within mandrel 258 (not shown). The pressure and heat used to cure mast layer 268 into mast 210 also bonds layer 268 to ridges 301 of insert 291 and mechanically locks insert 291 within hollow 287 by layer 268 extending into narrow width portion 307. Heating element 98 is adjustable to vary the ramp up, dwell and cool down times and temperatures.

Mast 210 is completed by removing mold 288 and mandrel 258, and cutting through outer layer 54 into the hollow center of spacer 84 to complete luff groove 12. A feed slot 20 (see FIG. 2) may also need to be cut in outer layer 54.

Although the invention has been described with reference to a particular arrangement of parts, features, steps, and the like, these are not intended to exhaust all possible arrangements, parts, steps, or features, and indeed many other modifications and variations will be ascertainable to those of skill in the art.

What is claimed is:

1. In a fiber-reinforced spar having inner and outer surfaces and a sail-attaching groove, the improvement comprising:

a layer of fiber forming both an inner surface of the spar and an outer surface of the spar; and a longitudinal insert, an outer surface of the insert bonded to an outer surface of said fiber layer, said fiber layer mechanically locking said insert in place upon curing of said fiber layer.

2. The fiber-reinforced spar of claim 1 wherein said fiber layer is seamless.

3. The fiber-reinforced spar of claim 1 wherein said fiber layer is woven.

4. A method of making a sailboat spar comprising the steps of:

forming a fiber layer on a male mandrel;

urging the layer outwardly from the male mandrel into a female mold;

urging the layer around an insert removably mounted within the mold by a groove mandrel;

curing the layer; and removing the groove mandrel from the insert.

5. The spar making method of claim 4 including, between the forming and urging steps, the step of reducing a circumference of the mandrel.

6. The spar making method of claim 5 wherein said forming step comprises weaving the fiber layer.

7. The spar making method of claim 4 wherein said first urging step comprises lowering pressure between the fiber layer and the mold.

8. The spar making method of claim 7 wherein said curing step further comprises vacuum bagging the mold.

9. The spar making method of claim 4 wherein said second urging step comprises raising a pressure within the fiber layer to press it around a wide diameter portion and into a narrow diameter portion of the insert.

10. The spar making method of claim 9 wherein said curing step comprises mechanically interlocking the insert into a hollow in said fiber layer.

* * * * *